United States Patent [19]

Eberle

[11] Patent Number: 4,767,116

[45] Date of Patent: Aug. 30, 1988

[54] PAGE STRAIGHTENER

[75] Inventor: Jürg Eberle, Hinwil, Switzerland

[73] Assignee: Ferag AG, Hinwil, Switzerland

[21] Appl. No.: 905,470

[22] Filed: Sep. 10, 1986

[30] Foreign Application Priority Data

Nov. 26, 1985 [CH] Switzerland ..... 05041/85

[51] Int. Cl.[4] ..... B65H 9/00; B65H 9/16; B65H 1/02; B65G 47/26

[52] U.S. Cl. ..... 271/238; 271/240; 271/248; 271/150; 271/250; 198/456; 198/627

[58] Field of Search ..... 271/238, 240, 248, 250, 271/253, 150, 151, 221, 222; 198/456, 846, 847, 627

[56] References Cited

U.S. PATENT DOCUMENTS

| | | | |
|---|---|---|---|
| 4,087,001 | 5/1978 | Daisley | 198/456 |
| 4,311,474 | 1/1982 | Standley | 198/847 X |
| 4,381,108 | 4/1983 | Newsome | 271/240 X |
| 4,502,586 | 3/1985 | Dusel et al. | 198/627 X |

*Primary Examiner*—Joseph J. Rolla
*Assistant Examiner*—Lisa C. Waag
*Attorney, Agent, or Firm*—Walter C. Farley

[57] ABSTRACT

The apparatus for the lateral straightening of printing products on a conveyor has guide members in the form of endless toothed belts arranged on opposite sides of the conveyor which are given, by motor-driven pulleys, a movement in the same movement direction and with approximately the same feed speed of the conveyed material. At the same time, the pulleys move inwardly toward each other, converging at the width of the printed products.

8 Claims, 3 Drawing Sheets

PAGE STRAIGHTENER

BACKGROUND OF THE INVENTION

The present invention relates to an apparatus for the lateral straightening or alignment of sheet material located on a conveyor, particularly for straightening a scale or flake flow or stream of printing products, as well as a method for operating the same.

The two-sided arrangement of metal members on a conveyor belt is known, whereby they are moved by a crank gear in such a way that they move together or straighten from the side to form the individual sheets of the scale or flake stream, i.e. the scale or flake stream elements, into a uniform stream.

In the case of the aforementioned apparatus with preferably metal guide members on either side of a conveyor belt and reciprocatable at right angles to the conveying direction of the printing product, there is supposed to be a reduction to the undesired braking or friction action occurring between the running scale stream and the stationary guide members during the conveying process compared with the previously known stationary guide members, i.e. those which are laterally fixed to a conveyor belt. This friction action through the printing product which abuts against the guide members and slides along the same is greatly dependent on the order of the scale stream. In extreme cases, there can be an uninterrupted braking action, leading to a greatly increased risk of disordered moving together of the scale stream and a resulting blocking of the printing product delivery. This danger is adequately counteracted by the aforementioned apparatus, in which the guide members are moved away from and then back towards the scale stream. In the case of this known apparatus, an uninterrupted braking action leading to accumulations or congestion need no longer be feared, but such accumulations can still occur with highly disordered scale streams or flows due to "collisions" of individual printing products.

Due to the greatly increased output of printing products as a result of the further development of printing presses, a need has arisen for a rapid, but trouble-free conveying of the printed sheet material from the printing presses to further processing means. Thus, the delivery speed of the printing product must be increased, so that inter alia new conveying problems occur in connection with the straightening of the scale flow as a result of the increased braking or friction action of the printing product coming into contact with the guidance means. In the case of high speed processes, such as are under discussion here, even minor faults lead to production stoppages which sometimes lead to high material losses.

SUMMARY OF THE INVENTION

An object of the present invention is to provide an apparatus for the lateral straightening of printing products located on a conveyor and in particular a scale stream of printing products, in which the undesired braking or friction action occurring during the conveying process between the guide members and the printing product is as far as possible eliminated and can at least be reduced to a minimum compared with the aforementioned known apparatuses. This is intended to lead to a very limited fault susceptibility during operation, even at a relatively high feed or conveying speed.

Another problem of the invention is to so develop the straightening apparatus, that it can be installed in mobile manner at the desired point on the scale stream. Thus, straightening means can be provided at several points on a production line, e.g. everywhere where an action in said stream changes the lateral order thereof.

The problem of the invention is solved in that said apparatus has two straigtening units arranged on either side of the conveyor and are provided with synchronous motor-driven, endless toothed belts, which bring about the straightening of the scale stream.

The invention is based on the idea that the braking or friction action of straightening elements on the more rapidly moving scale stream elements, apart from the known measures such as ideal material pairing, surface changes to one of the two contacting means, etc., can be reduced or even eliminated by reducing and minimizing the relative speed between the contacting means, i.e. in this case the scale stream elements and the straightening elements.

The solution of the problem according to the invention also permits a relatively simple construction of the movable components and the use of specifically lighter materials, so that the necessary higher operating speeds can be achieved even in the case of eccentric operation.

In an advantageous development of the invention, constructional means are provided for modifying the spacing between two straightening units of the apparatus for adapting to the particular width of a scale stream.

In each case one side of the toothed belts arranged on both straightening units is located parallel to the conveyor, i.e. to the flake stream over the entire length on the side facing the conveyor or the flake stream and, considered cross-sectionally, forms a U-shaped channel with the conveyor. Moreover, the outer circumferences of the pulleys and the insides of the endless toothed belts carry teeth, which mesh with one another.

According to a preferred embodiment, each pulley has an eccentrically arranged bore, which serves to receive a driving shaft and also a loosely rotatably mounted shaft. The two pulleys constructed in the manner of a cam and arranged on a straightening unit have circumferences of equal size and are connected to one another by means of the endless toothed belt in such a way that in the case of a complete revolution and in each position, together with the endless toothed belt they have the same spacing from the conveyor or the flake stream.

To reduce wear, the toothed belts are appropriately given a plastic coating on their outside surfaces. The material to be used can be chosen with a view to obtaining a minimum friction coefficient.

Further development possibilities of the invention can be gathered from the following description.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
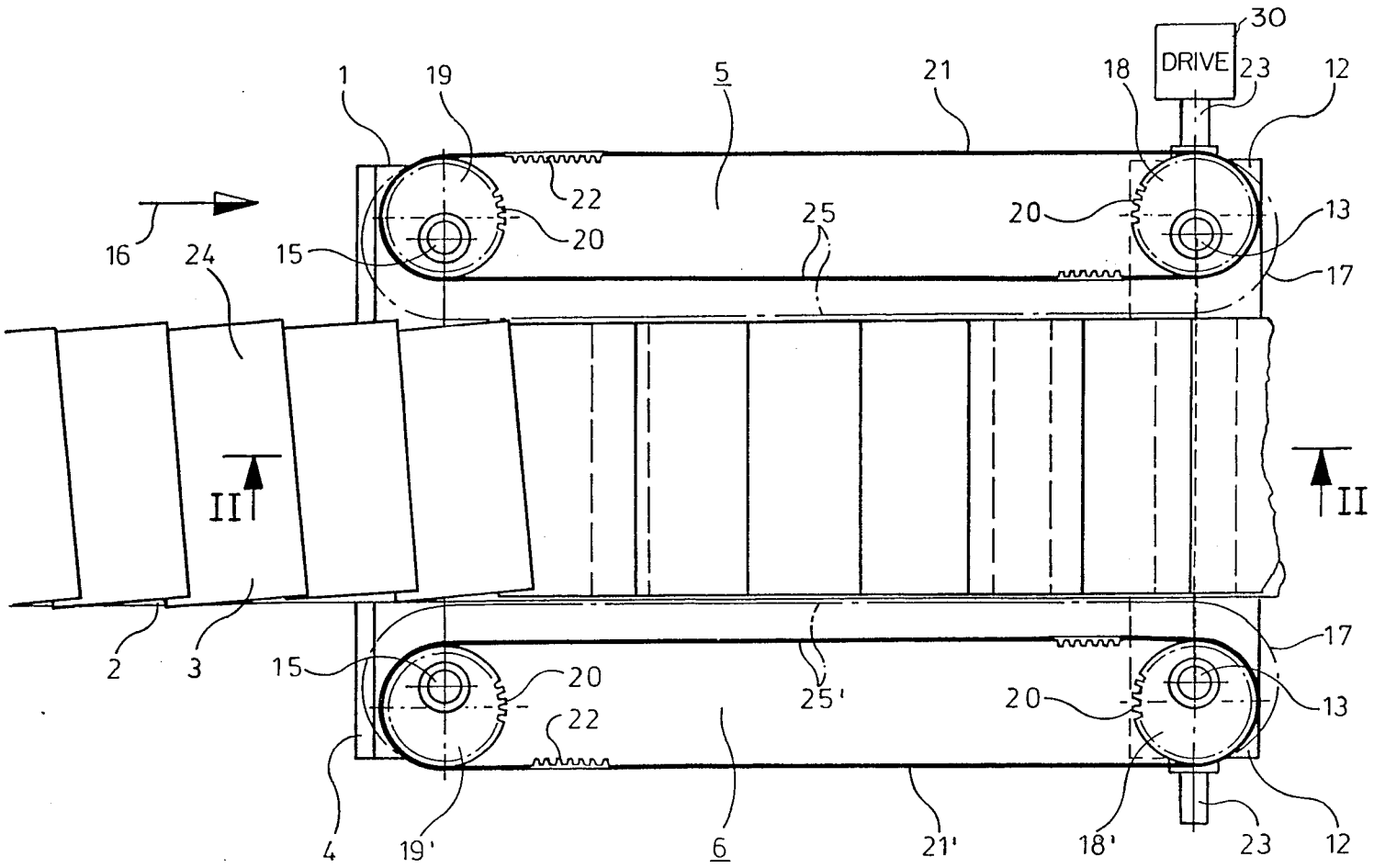
FIG. 1 is a top plan view of an apparatus in accordance with the invention for straightening printing products on a conveyor belt.
Figure 2:
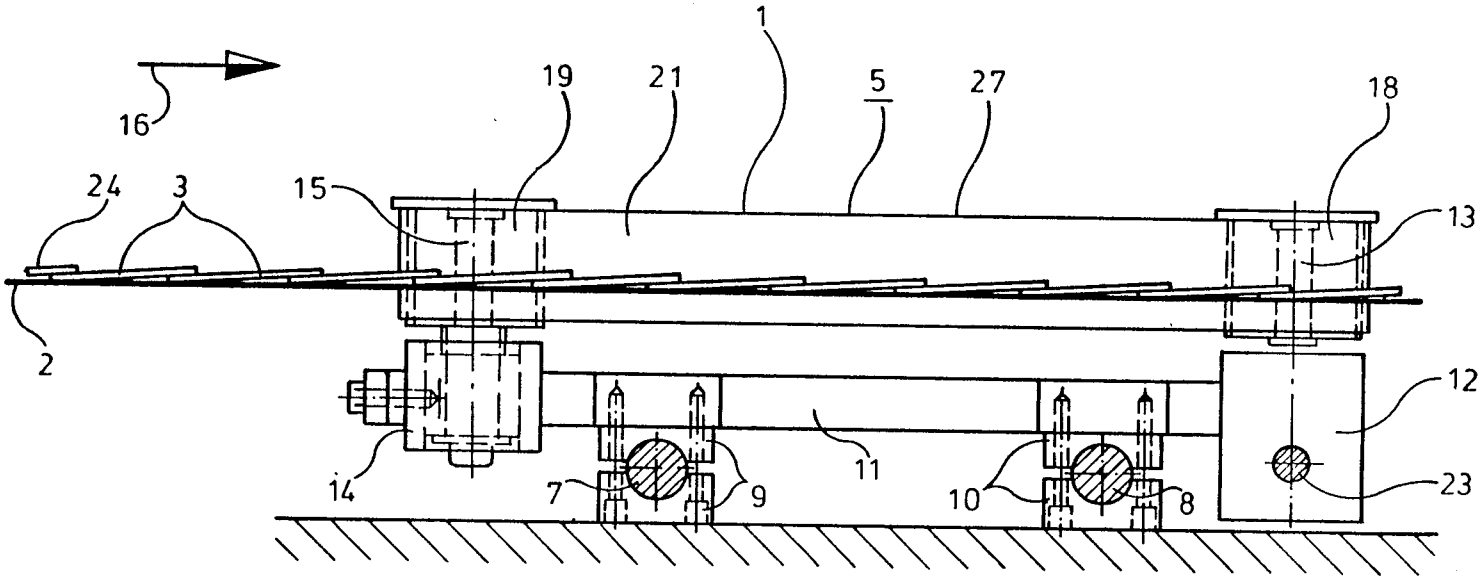
FIG. 2 is a side elevation in longitudinal section through the conveyor belt of FIG. 1, as well as through a frame of the straightening apparatus along line II—II of FIG. 1, the side view showing the construction of the apparatus for straightening printing products located on a conveyor belt.

The apparatus 1 for the lateral straightening of printing products 3 located on a conveyor 2 according to the preferred embodiment and shown in FIGS. 1 and 2 has a frame 4 to which are fixed two motor-driven straightening units 5, 6 having an adjustable spacing from one another, the units being driven by a drive 30. Frame 4 of apparatus 1 has two rods 7, 8 for the stable connection of the two straightening units which extend through under conveyor 2 at right angles to the conveying direction.

In the lower region of straightening units 5,6 screw clips 9,10 are fixed thereto and are reciprocatably guided for adjusting the spacing between the two straightening units 5,6 on rods 7,8 of frame 4 and can be locked to said rods. Thus, the apparatus can be set to any desired width of the printing product supplied or to the different widths of the scale stream.

The two screw clips 9,10 are in turn interconnected by means of a support 11 of a support structure of the straightening units 5,6. On one end of support 11 is arranged a gear 12, e.g. a bevel gear, for a first driving shafts 13, vertically mounted thereon, in each of pulleys 18,18' which are constructed in the manner of a cam and provided with eccentric bores, whilst on the other end of support 11 is provided a pedestal bearing 14 for second shafts 15 which is vertically, loosely rotatably mounted therein and to which are fixed in non-rotary manner a pulleys 19,19' provided with eccentric bores and also constructed in the manner of a cam.

On the two equally large circumferences of pulleys 18,18' and 19,19' is provided a tooth system 20, which engages the tooth system 22 of toothed belts 21,21' interconnecting the two pulleys 18,19 or 18',19'. The eccentricity of the two pulleys 18,19 or 18',19' is substantially the same and with respect to a common rotation angle are cophasal to one another.

Both of the pulleys 18,19 or 18',19' constructed as cams are consequently so interconnected by means of the endless toothed belt 21,21' that in any rotational position, throughout the complete rotation thereof they always have the same spacing from conveyor 2, preferably constructed as a belt conveyor, or from a scale stream 21 formed from printing product 3 (approximate phase coincidence).

The two straightening units 5,6 are constructed in the same way as described hereinbefore. In order to ensure synchronous running of the two straightening units 5,6, the two gears 12 of the two units 5,6 are mechanically interconnected to a connecting shaft 23 by means of a not shown drive. The eccentric pulleys 18,18' and 19,19' are so pairwise positioned with respect to one another that they operate in opposite directions and the two toothed belt sides 25,25' perform a stroke or travel moving towards and then away from one another.

Particular mention is made of the fact in this connection that the two straightening units 5,6 can be operated by a single motor arranged on one of the two units, but also by a gear shaft driving both units and which is in turn decentrally driven by a motor. For synchronizing the straightening units with the conveyor, the decentral drive can be tapped therefrom.

With a view to the different widths of the scale streams 24 to be fed in accordance with the dimensions of the printing product 3, as stated hereinbefore, the desired spacing between the two straightening units 5,6 can be set as required with the aid of screw clips 9,10.

Frame 4 of straightening apparatus 1 and the two straightening units 5,6 thereof are constructed in such a way that in each case one side 25,25' of the two toothed belts 21,21' is parallel to conveyor 2, i.e. to the conveying direction of the scale stream 24 over its entire length on the side facing conveyor 2 and that, considered in cross-section, it forms together with conveyor 2 a U-shaped channel, in which the scale stream 24 passing through is straightening on both sides.

The widths of the two toothed belts 21,21' are such that the upper edges 27 thereof project above the printing product 3 located on conveyor 2. The outside surfaces of the toothed belts can be given a special plastic coating, e.g. a teflon coating to reduce wear. Such a coating can also reduce the friction coefficients of the belt surface.

The described holding or securing device for the straightening units 5,6 with belt 4 and adjusting members 7,8 or 9,10 for setting the straightening unit to different widths of the printing product can, with respect to conveyor 2, be positioned overhead, which aids the mobility of the complete apparatus. Thus, the two straightening units form a U-shaped channel together with the conveyor.

The straightening apparatus described in FIGS. 1 to 3 is operated in the following manner. According to the embodiment of FIGS. 1 and 2, the toothed belt 21 arranged on the two straightening units 5,6 is given a movement on belt side 25 in the direction of arrow 16 at a speed corresponding to the movement direction and conveying speed of conveyor 2 by means of gear 12 and with the aid of a drive motor by means of pulley 18.

By means of the pulleys 18,18' and 19,19' constructed in the manner of cams, the two toothed belts 21,21' during a complete revolution of the pulleys are moved into the position indicated by dot-dash line 17 in FIG. 1 and laterally move together the printing product 3 of scale stream 24 during the conveying process in the same way as collating left and right hands. After reaching the position of toothed belts 21,21' indicated by dot-dash line 17, they are returned to the position indicated by the solid line. During a further revolution of pulleys 18,19, the aforementioned movement sequence of the two toothed belts 21 is repeated. The toothed belts of the straightening units or the two sides 25,25' describe a stroke which is perpendicular to the scale stream. The sides 25,25' running along the scale stream 24 reciprocally move towards one another to the width of the scale stream and move together disordered scale stream elements in the case of a minimum conveying speed in the conveying direction to give an equally wide line of printing products. When the sides move apart, the disordered scale stream passes into the now wider U-shaped channel and, before it has passed through the straightening apparatus, is moved together again in the next stroke. On moving together, the toothed belts run approximately at the scale stream speed, so that during moving together or any chance contact of the scale stream elements with the toothed belt, no unforeseen disorder occurs, e.g. by moving the scale stream elements together in the feed direction (varying the scale spacing). This takes place in alternating manner at a speed adapted to the printing product feed.

Figure 3A:
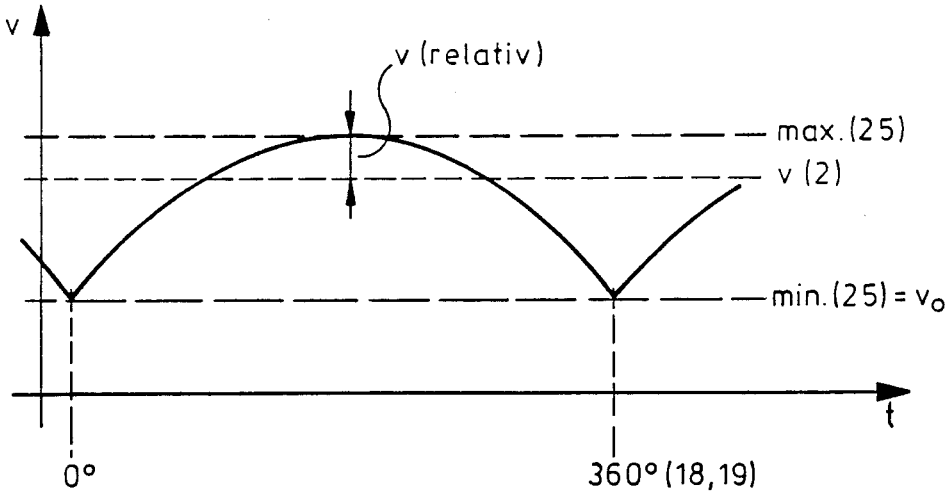
FIGS. 3A and 3B are graphical and schematic illustrations showing method details for the operation of the apparatus according to the invention, including the relative speed of the collator toothed belt and the printing product to be collated.
Figure 3B:
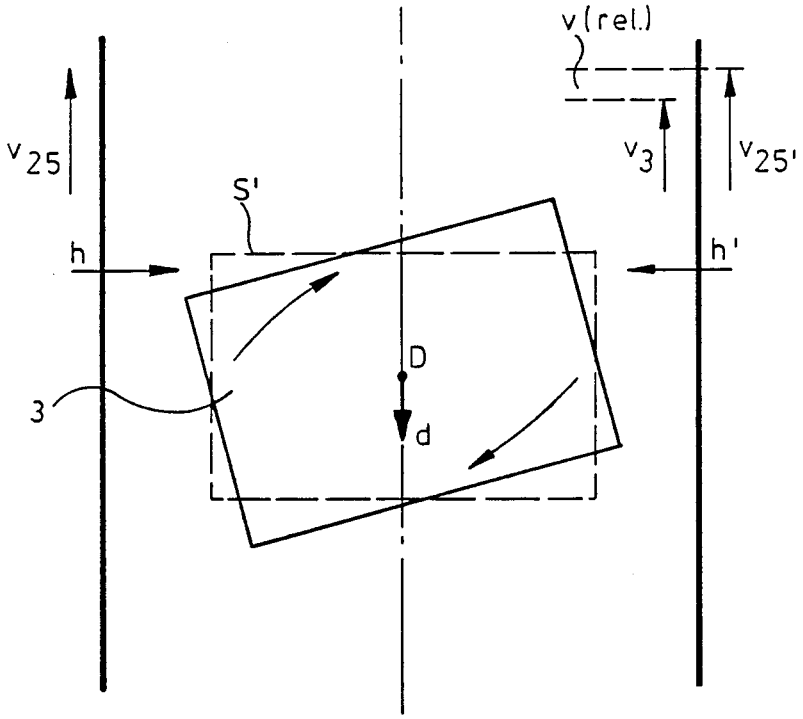

FIGS. 3A and 3B show method details for the operation of the apparatus according to the invention. Information is thereby given on the dimensioning of functional parts in connection with the design of the apparatus and for estimating approximate operational quantities such as speeds, time behaviour, etc. In a speed-time diagram or graph, FIG. 3A shows the speed change of the revolving toothed belts, e.g. as a moving point on the toothed belt side 25 or 25' running parallel to printing product 3 over a complete revolution of the eccentric pulley 18 or 19. The 0° position corresponds to the position of the pulleys, as shown in FIG. 1. The driven toothed belt runs at a basic speed vO around the pulley and as a result of the eccentric lever undergoes an additional acceleration to a total speed which, after half a pulley revolution, reaches its maximum at 180°. The superimposed speed then decreases again and at 360° the total speed again reaches the basic speed. Simultaneously an ordering or collating stroke of the side 25 is performed. Vmin (25) and Vmax (25) on the one hand indicate the minimum speed of a point on side 25, i.e. basic speed vO and on the other its maximum speed on contacting the printing material during the collating stroke. The ratio Vmin/Vmax is a function of the eccentricity. For example, in the case of a pulley diameter of 6 to 7 cm and an eccentricity of approximately 1:2 at aproximately 200 r.p.m. speeds of Vmin approximately 0.4 to 0.5 m/s and Vmax 0.8 to 1.0 m/s are obtained for a simultaneous stroke of approximately 2 cm. These are realistic operational quantities for a high speed conveying of printing products.

These speeds are in turn dependent on the speed v2 of the conveyor belt 2 running between the two straightening units and from which the toothed belt drive is preferably tapped. In order to keep low the speed difference v (relative) between the sides 25,25' and the printing material 3 to be collated, every effort is made to match Vmax (25) to v2. It is assumed that the frequency of the contacts between the printing material and the straightening apparatus increase in the direction of a collating stroke and occur most frequently (up to each time) at the maximum stroke. If, when contacting takes place, the speed difference is low enough to eliminate the disturbing friction and therefore a braking action on the printing material, then the scale spacings undergo no change despite the straightening of oblique scale elements. This is represented in conjunction with FIG. 3B.

An oblique printing product 3 (within the scale stream) is to be straightened by an oppositely directed stroke movement of toothed belt side 25,25'. The printing product which is also oblique to the requisite scale spacing S should have its e.g. original scale spacing in the case of correct positioning. The two sides 25, 25' approaching printing product 3 move at speed V25 or V25' and the printing material moves at speed v3 approximately $<$v25=v25'. Due to the stroke movement h,h', a rotation (torque) about an imaginary axis D is performed on the oblique printing product and consequently the correct position indicated by upper edge S is reached, without the printing product being significantly moved in the scale stream running direction, e.g. in direction $d=f(Vrel)$, cf. arrow.

The straightening apparatus naturally does not only correct oblique printing products in ordered or collated layers, but also lateral displacements, such as can occur when supplied from a rotary printing process. Scale streams positioned in this way are centred by deflection on the conveyor.

As a result of the "revolving" straightening members (of the toothed belts), as opposed to fixed members, the speed difference is kept within limits (v3 to Vmin(25)) and therefore a substantially random increase to the product feed speed is possible. As a result of the eccentricity the collating stroke is obtained and this is also superimposed in the form of a speed increase on the toothed belt speed. The stroke and undulation of the total speed can be determined with the eccentricity ratio. By proximating the speeds of two systems with different functions, namely transporting through the conveyor and displacement through the straightening unit, it is possible to perform manipulations, which was not possible with the speed difference in known means, namely an in situ rotation of an individual oblique printing product (without moving it significantly in the conveying direction). This is now possible in an upwardly open speed range, so that the proposed apparatus is particularly suitable for high speed printing processes.

What is claimed is:

1. A method of operating an apparatus for straightening sheet-like articles in a scale stream carried on a conveyor surface moving at a predetermined speed of the type comprising first and second straightening units each comprising an elongated endless belt having a toothed inner surface and a smooth outer surface, and a pair of toothed, spaced pulleys engaging the inner surface of said belt; and means for mounting said straightening units on opposite sides of said conveyor and for driving said pulleys so that the portions of said pulleys engaging said belt and substantially flat portions of said outer surfaces of said belts synchronously translate toward each other and away from each other and toward and away from said scale stream while remaining substantially parallel, comprising setting the speed of travel of said belts at a speed substantially equal to said predetermined speed of said conveyor when said belts are at their closest points by driving the belts from the same drive as is used to drive the conveyor.

2. A method according to claim 1 and including eccentrically driving said pulleys so that a flat surface of said belt moves toward and away from the conveyor while remaining parallel with itself, setting the belt speed at the point of farthest separation from said scale stream to be lower than the predetermined conveyor speed so that the speed added by the eccentric motion to the drive speed causes the belt to substantially equal to conveyor speed at the closest point of approach.

3. An apparatus for straightening sheet-like articles in a scale stream carried on a conveyor surface moving at a predetermined speed comprising first and second straightening units, each of said straightening units comprising an elongated endless belt having a toothed inner surface and a smooth outer surface, and a pair of toothed, spaced pulleys engaging the inner surface of said belt; and means for mounting said straightening units on opposite sides of said conveyor and for driving said pulleys so that the toothed portions of said pulleys and substantially flat portions of said outer surfaces of said belts synchronously translate toward each other and away from each other and toward and away from said scale stream while remaining substantially parallel and so that said outer surfaces travel at a longitudinal speed substantially equal to said predetermined speed when said belts are at their closest points.

4. An apparatus according to claim 3 wherein said means for mounting includes means for adjusting the spacing between said belts at their closest points for adapting to the width of a scale stream.

5. An apparatus according to claim 4 wherein said means for mounting and driving includes, in each straightening unit, means defining an eccentric bore in each of said pulleys, a drive shaft extending into said bore in one said pulley, and a rotatably mounted shaft extending into the other said pulley.

6. An apparatus according to claim 5 wherein the diameters of the pulleys in each pair are the same.

7. An apparatus according to claim 3 wherein said belts and pulleys are constructed so that at any rotational position through a complete revolution, the pulleys of either straightening unit are equidistant from said scale stream.

8. An apparatus according to claim 7 wherein said outer surface of each said belt includes a low-friction coating of plastic material.

* * * * *